US007032640B2

(12) United States Patent
Anzai et al.

(10) Patent No.: US 7,032,640 B2
(45) Date of Patent: Apr. 25, 2006

(54) METHOD OF MOLDING LOW MELTING POINT METAL ALLOY

(75) Inventors: Kazuo Anzai, Nagano-ken (JP); Koji Takei, Nagano-ken (JP); Ko Yamazaki, Nagano-ken (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 0 days.

(21) Appl. No.: 11/066,601

(22) Filed: Feb. 25, 2005

(65) Prior Publication Data

US 2005/0194117 A1 Sep. 8, 2005

(30) Foreign Application Priority Data

Feb. 27, 2004 (JP) ..... 2004-055274

(51) Int. Cl.
*B22D 17/08* (2006.01)
*B22D 23/00* (2006.01)
*B22D 25/00* (2006.01)

(52) U.S. Cl. ..... 164/113; 164/900

(58) Field of Classification Search ..... 164/113, 164/900

See application file for complete search history.

(56) References Cited

U.S. PATENT DOCUMENTS

2001/0020526 A1 9/2001 Motegi et al.
2004/0182537 A1* 9/2004 Takizawa et al. ..... 164/113

FOREIGN PATENT DOCUMENTS

JP 2001-252759 9/2001
JP 2003-200249 7/2003

* cited by examiner

*Primary Examiner*—Kuang Y. Lin
(74) *Attorney, Agent, or Firm*—Weingarten, Schurgin, Gagnebin & Lebovici LLP

(57) ABSTRACT

A method of molding a low melting point metal alloy which exhibits thixotropy properties at a solid-liquid coexisting temperature, said method comprising the steps of heating said metal alloy at a temperature in the solid-liquid coexisting temperature region to form a semisolid, supplying said semisolid to a heating/holding cylinder to be accumulated, and injecting said semisolid into a mold. At the end of the molding process, a remaining semisolid material is heated to a wholly molten state, then discharged by injection, and heating is stopped so that the molding operation is finished; or, at a temporary suspension of molding, an accumulated material is heated to a wholly molten state and, at the resumption of molding, the temperature of the heating holding cylinder is lowered to the original solid-liquid coexisting temperature region while discharging said wholly molten material by injection and resupplying with new semisolid molding material.

6 Claims, 3 Drawing Sheets

METHOD OF MOLDING LOW MELTING POINT METAL ALLOY

This application claims priority to a Japanese application No. 2004-055274 filed Feb. 27, 2004.

BACKGROUND OF THE INVENTION

1. Field of the Invention

The present invention relates to a method of molding a low melting point metal alloy such as a magnesium alloy, an aluminum alloy or the like using a metallic raw material, which exhibits thixotropy properties in a solid-phase and liquid-phase coexisting temperature region.

2. Description of the Related Art

A method of molding a magnesium alloy comprises the steps of melting a metallic raw material into a liquid alloy at a liquidus temperature or higher, causing the obtained liquid alloy to flow downward on a surface of an inclined cooling plate to cool the alloy rapidly in a semi-molten metal state, holding the semi-molten metal alloy in a storage tank at a temperature in a solid-phase and liquid-phase coexisting temperature region to form a metal slurry (semisolid) having thixotropy properties, casting the metal slurry to a metallic raw material potentially having thixotropy, heating this metallic raw material in a semi-molten metal state with an injection device, and injecting the heated metallic raw material into a mold to mold the material into an article while accumulating the heated metallic raw material.

Further as a molding means for a magnesium alloy or the like, a means is known that it includes a heating means on an outer circumference of a cylinder body having a nozzle opening at the end, and supplies a metallic material in a thixotropy state to a molten metal holding cylinder (heating holding cylinder) in an end portion of which a measuring chamber connected to the nozzle opening is formed with diameter reduced while being accumulated therein, and then injects the metallic material into a mold after measuring the metallic material by forward and backward movements of an internal injection plunger.

The above-mentioned related arts are disclosed in Japanese Laid-Open Patent Publications No. 2001-252759 and No. 2003-200249.

A semisolid material, which exhibits thixotropy properties in a solid-phase and liquid-phase coexisting temperature region, has a fluidity of a low viscosity by coexistence of a liquid phase and finely spheroid solid phase. This semisolid material is heated at a temperature in a solid-phase and liquid-phase coexisting temperature region because thixotropy properties must be kept until the material is injected. Since the solid phase is grows with the lapse of time even at a temperature in the solid-phase and liquid-phase coexisting temperature region, a solid-phase fraction is increased with the lapse of time and the density of the solid phase is increased so that the fluidity is lowered. Therefore, the injection of accumulated semisolid material is preferably carried out within allowable time.

When such a semisolid material is kept at a temperature in a solid-phase and liquid-phase coexisting temperature range and the molding of the material is temporarily suspended while leaving the material in a heating holding cylinder as it is, the fluidity of the semisolid material is lowered by growth of a solid phase during the suspension and it becomes difficult to perform injection by resuming the molding. If the suspension time is within allowable time the injection can be continued. However, if the suspension time is prolonged, the viscosity of the material is increased by largely grown solid phase and a flow resistance is increased whereby smooth injection cannot be made. The largely grown solid phase can be a cause of scuffing to an injection plunger or clogging or the like and the molding of the material cannot be performed.

When the molding operation of such a semisolid material is finished without discharging the remaining material at the end of molding, the solid phase continues to grow until the semisolid material reaches a solidus temperature whereby the semisolid material becomes a solid. Even if the solid is again heated to the temperature in the solid-phase and liquid-phase coexisting temperature region to be in a semi-molten metal state, since a once grown solid phase is not changed into a small solid, the solid does not return to an original semisolid material, which exhibits thixotropy properties whereby it becomes a semisolid material, which has a high viscosity and an extremely low fluidity. Thus the injection of the semisolid material as it stands becomes impossible.

The remaining semisolid material can be solved by repeating injection operation to discharge the material at the end of molding. However, even if the injection operation for the remaining semisolid material is repeated in a semisolid state, a part of the material often adheres to and remains on an inner wall surface of the heating holding cylinder, the injection plunger or the like. This adhered material is not melted at a temperature in the solid-phase and liquid-phase coexisting temperature region. Thus, when a new material is supplied without removing an adhered material and a molding operation of the material is started, the adhered material causes scuffing, clogging or the like in the injection plunger. Accordingly, the heating holding cylinder must be heated to a liquidus temperature or higher to melt and discharge the adhered material before the starting of molding.

SUMMARY OF THE INVENTION

The object of the present invention is to provide a new method of molding a low melting point metal alloy, which can solve the above-mentioned problem due to a remaining semisolid material at the end of the molding operation and the problem generated when molding is temporarily suspended while leaving the semisolid material in a heating holding cylinder as it is, by discharging the semisolid material in a wholly semimolted metal state with a simple means.

The object of the present invention is attained by a method of molding a low melting point metal alloy comprising the steps of, while using a metallic raw material, which exhibits thixotropy properties in a solid-phase and liquid-phase coexisting temperature region, as a molding material, heating said molding material at a temperature in the solid-phase and liquid-phase coexisting temperature region to form a semisolid material, supplying a required amount of said semisolid material to a heating holding cylinder to be accumulated, and injecting said semisolid material into a mold by one shot from said heating holding cylinder, wherein a remaining semisolid material at an end of molding is heated at a liquidus temperature or higher to be melted, the material is injected in a wholly molten metal state and discharged from said heating holding cylinder, and heating is stopped so that the molding operation is finished. The discharge of the remaining semisolid material is performed by supplying a metallic raw material having the same composition as the molding material.

Further, the object of the present invention is attained by a method of molding a low melting point metal alloy comprising the steps of, while using a metallic raw material, which exhibits thixotropy properties in a solid-phase and liquid-phase coexisting temperature region, as a molding material, heating said molding material at a temperature in the solid-phase and liquid-phase coexisting temperature region to form a semisolid material in a solid-phase and liquid-phase coexisting state, supplying a required amount of said semisolid material to a heating holding cylinder to be accumulated, and injecting said semisolid material into a mold by one shot from said heating holding cylinder, wherein a temporary suspension of molding is performed by increasing a temperature of said heating holding cylinder to a liquidus temperature or higher and allowing an accumulated semisolid material to be in a wholly molten metal state, a temperature of said heating holding cylinder is lowered to a temperature in the original solid-phase and liquid-phase coexisting temperature region while performing the discharge of the material in a wholly molten metal state by injection of thereof and the supply of the molding material at the resumption of molding, so that the content in the heating holding cylinder is replaced with the supplied molding material, and molding is started. Even in the above-mentioned methods stirring is performed in the wholly molten metal state.

In this invention, when a situation of a temporary suspension arises, a temperature of the heating holding cylinder is increased to a liquidus temperature or more and an accumulated semisolid material is kept in a wholly molten metal state. Thus a disadvantage at the resumption of molding due to the growth of a solid phase during the suspension can be prevented. Accordingly, since, after the wholly molten material has been discharged by a temporary molding, a regular molding can be started, the molding can be resumed with a short time irrespective of length of temporary suspension time.

Further, since, at the end of molding the semisolid material is discharged in a wholly molten state hardly having viscosity, it does not remain on an inner wall surface of the heating holding cylinder or an injection plunger or the like without being adhered thereto whereby the inside of the heating holding cylinder is cleaned. Thus since a removing operation of a remaining material is omitted at the next molding and the starting up time of the molding can be shortened, the molding efficiency is improved. Additionally, a change of materials can be smoothly performed.

DESCRIPTION OF THE PREFERRED EMBODIMENTS

Figure 1:
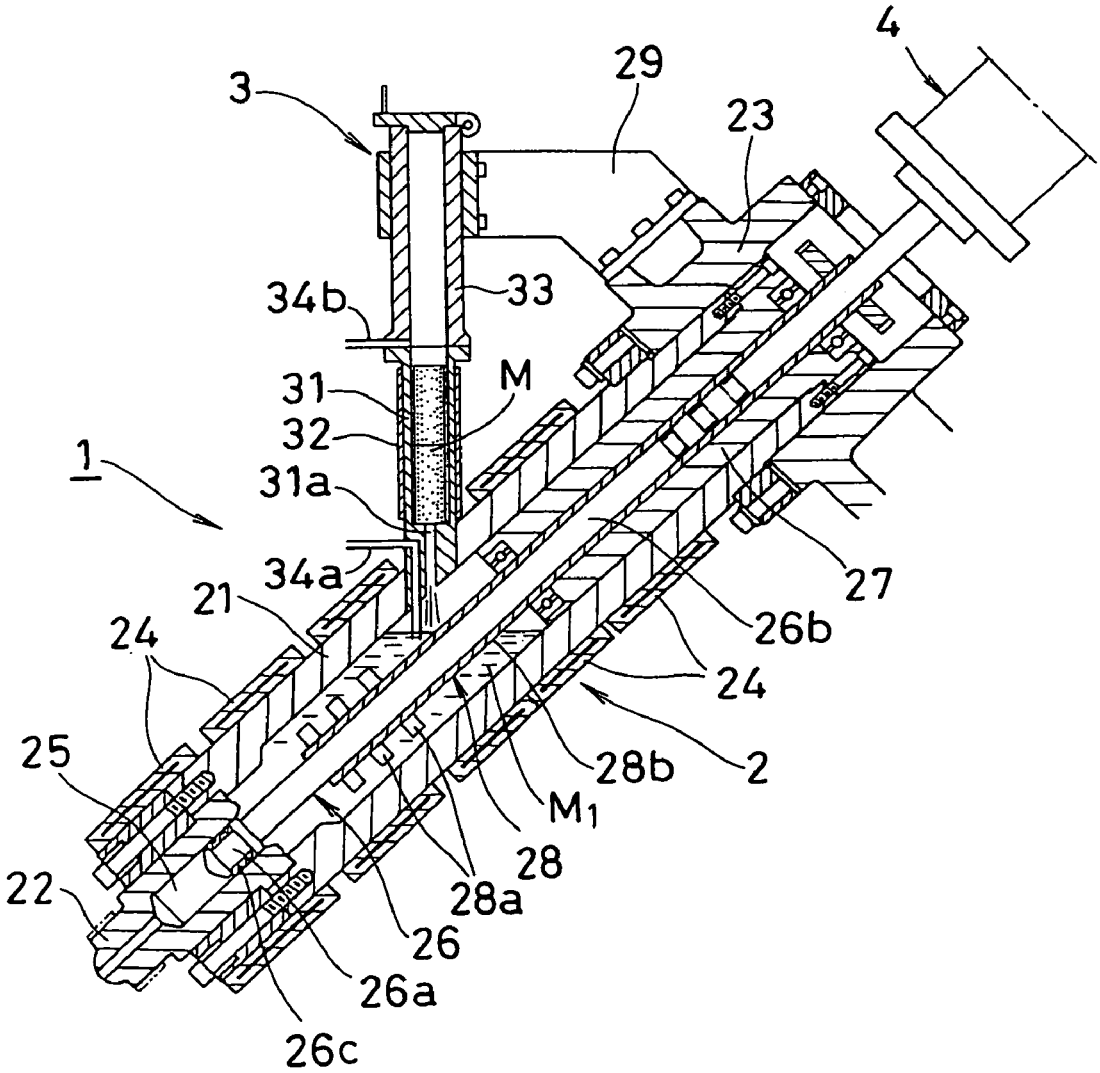
FIG. 1 is a vertical cross-sectional side view of an embodiment of a metal molding machine, which can adopt a molding method according to the present invention.

The reference numeral 1 in FIG. 1 denotes a metal molding machine. The metal molding machine 1 is comprised of a heating holding cylinder 2 having a nozzle member 22 at an end of a cylinder body 21, a melting supply device 3 for a short columnar molding material M, and an injection drive 4 on a rear portion of the heating holding cylinder 2.

The molding material M consists of a solid cast into a columnar body (also called as a round bar) obtained by rapidly cooling a molten metal at a temperature in a solid-phase and liquid-phase coexisting temperature region and cooling a semi-molten alloy containing a finely spheroid solid phase, and consists of metallic raw material of a low melting point metal alloy, which becomes a semisolid exhibiting thixotropy properties in a solid-phase and liquid-phase coexisting temperature region.

The heating holding cylinder 2 includes the melting supply device 3 in a supply opening provided on a substantially middle upper side of the cylinder body 21, and a heating means 24 of a band heater on the outer circumference of the cylinder body. This heating means 24 is set at a temperature in the solid-phase and liquid-phase coexisting temperature region between a liquidus temperature and a solidus temperature of a low melting point metal alloy (for example, a magnesium alloy and an aluminum alloy) used as the molding material M.

The heating holding cylinder 2 is attached to a supporting member 23 at a rear end portion of the cylinder body, and is obliquely provided at an angle of 45° with respect to the horizontal plane together with the injection drive 4. The inside of the end portion communicating with the nozzle opening of the nozzle member 22 positioned downward by this slant arrangement of the heating holding cylinder 2, forms a measuring chamber 25. To the measuring chamber 25 is slidably insertion-fitted an injection plunger **26*a* of an injection means 26, which is protrusively and retractively moved by the injection drive 4. This injection plunger 26*a* protrusively and retractively includes a check valve 26*c* in the outer circumference of which a seal ring is buried, on a circumference of the shaft portion, and the space between the check valve 26*c* and the shaft portion forms a flow passage for the semisolid material M1 in a solid-phase and liquid-phase coexisting state although not shown. The opening and closing of the flow passage is carried out by contact and separation between a rear end surface of the check valve 26*c*** and the seat ring on a rear portion of the injection plunger.

A rod **26*b* of the injection means 26 is protrusively and retractively inserted into a hollow rotating shaft 28*b* in a stirring means 28 provided in the cylinder body while penetrated into a blocking member 27 in the upper portion of the cylinder body 21. Further, a plurality of stirring blades 28*a* are provided on a circumference of an end portion of the rotating shaft 28*b*. To a rear end protruding from a blocking member 27** is connected a rotating drive not shown.

The melting supply device 3 forms a bottom portion by blocking the inside of an end portion of an elongated pipe body, and is comprised of a melting cylinder 31 on the bottom portion of which a supply flow passage **31*a* is provided, a heating means 32 such as a band heater or a induction heater temperature-controllably provided on the outer circumference of the melting cylinder 31 with a plurality zones partitioned, and a supply cylinder 33 vertically connected to an upper portion of the melting cylinder 31. In the heating means 32** a low melting point metal alloy used as the molding material M is set at a temperature in the solid-phase and liquid-phase coexisting temperature region.

It is noted that in case where the molding material is granules such as chips a hopper is provided on the upper end of the supply pipe 43.

Further, the melting supply device 3 is vertically provided on the heating holding cylinder 2 by inserting a bottom portion side of the melting cylinder 31 into a material supply opening provided on the cylinder body 21 and attaching the supply cylinder 33 to an arm member 29 fixedly provided on the supporting member 23 and is provided with filling pipes 34*a* and 34*b* for inert gas such as argon gas from the lower portion of the melting supply device to the inside of molten alloy of the heating cylinder 2, and to an upper space of the melting cylinder 31, respectively as shown in FIG. 1.

In the melting supply device 3 when a molding material M for a number of shots is dropped from the upper opening of the supply pipe 31 to a bottom surface of the melting pipe 31, the molding material M is melted by heating from the circumference of the melting pipe 31. However, a molding material M including a spheroid solid phase gradually flows out of the supply passage 31*a* into the cylinder body 21 in a solid-phase and liquid-phase coexisting state prior to be wholly melted and is accumulated in a heating holding cylinder 2 heated at a liquidus temperature as the semisolid material M1. The temperature of the accumulated semisolid material Ml is held at a temperature in a solid-phase and liquid-phase coexisting temperature region until the semisolid material M1 is injected after measurement. In case where the molding material M is a magnesium alloy (AZ 91D) a temperature of the heating means 32 is set at 560° C. to 590° C. and a heating means 24 of the heating holding cylinder 2 is set at 560° C. to 610° C.

A part of the semisolid material M1 accumulated in the heating holding cylinder 2 is allowed to flow into the measuring chamber 25 through the flow passage by the forced retreat of the injection plunger 26*a* and is accumulated in the measuring chamber 25 as one shot. After measuring, the semisolid material M1 is injected from the nozzle 22 to a mold not shown directly or through a hot runner by forced advance of the injection plunger 26*a* to be a required-shaped article.

The solid-phase fraction of the semisolid material M1 is different according to the temperature. However, a spherical solid phase is grown to be enlarged with the time passage irrespective of the difference between solid-phase and liquid-phase coexisting temperatures and consequently the solid-phase fraction is increased and the density of the solid phase in the liquid phase is also increased. In the above-mentioned magnesium alloy, the solid-phase fraction after holding the alloy for 30 min. at 570° C. becomes 69% and although the solid phase is generally grown largely a solid phase, which exceed 200μ is small, and the thixotropy properties are held. When the holding time exceeds 30 min., a solid-phase fraction, which exceeds 200μ is increased to reach even 75% or more whereby fluidity is decreased.

The semisolid material M1 accumulated in the heating holding cylinder 2 is the same as mentioned above. If the accumulation time is within 30 min., the measuring by forced retreat of the injection plunger 26*a* and the injection to the mold by forced advance can be smoothly performed without any trouble. However, when 30 min. has passed in the accumulation time, fluidity is lowered, and the flow passage is clogged with a largely grown solid phase, so that sending of the semisolid material M1 to the measuring chamber 25 by a retreat of the injection plunger 26*a* becomes bad. Thus the measuring of the semisolid material M1 every molding becomes unstable, which is liable to be a short shot due to the shortage of an injection amount of the semisolid material M1 into the mold.

When the molding of such a semisolid material M1 is suspended (an interruption of molding) without stopping heating with the material M1 accumulated in the heating holding cylinder 2, the viscosity is increased by growth of a solid phase during the suspension so that the fluidity of the material is remarkably lowered and the material becomes a molding material having a large flow resistance. Consequently, the measuring and injection of the molding material by forward and backward movements of the injection plunger 26*a* cannot be smoothly made at restart of molding. Thus, when the suspension time exceeds 30 mm., the temperature of heating holding cylinder 2 is increased from a temperature in the solid-phase and liquid-phase coexisting temperature range to a liquidus temperature or higher and the semisolid material M1 is wholly melted so that the inside of the heating holding cylinder 2 is replaced with a wholly molten material. After that the suspension of molding is performed without heating the material.

In a state where the wholly molten material is kept at a liquidus temperature or higher, all materials are a liquid phase and a primary crystal, which will become a solid phase, is not produced and even if time has passed the liquid phase is not changed. Thus, in case where the material is accumulated in a wholly molten metal state, even if the suspension time is prolonged, a disadvantage due to the growth of a solid phase is not caused. Even if this wholly molten material is cooled at a temperature in the solid-phase and liquid phase coexisting temperature region, it does not return to the original molding material. Accordingly, the wholly molten material is discharged at the start of molding and must be replaced with a new molding material.

This replacement is transferred to a normal molding after the temperature of the heating holding cylinder 2 has been lowered to a predetermined temperature in a solid-phase and liquid-phase coexisting temperature region while performing the supply of a new molding material and the discharge of the accumulated wholly molten material by injection, and the wholly molten material has been replaced with a supplied molding material. Consequently, since no disadvantage of molding due to the growth of a solid phase during a suspension of molding occurs, restart of molding after the suspension time can be performed without any trouble.

Figure 2:
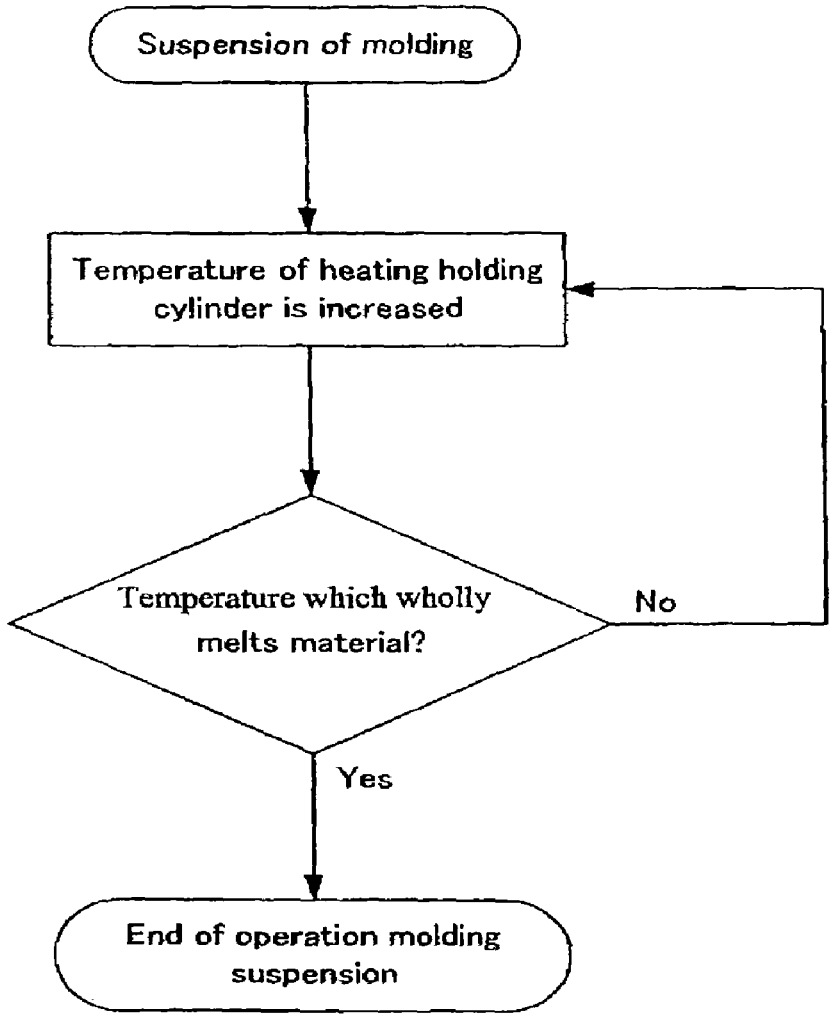
FIG. 2 is an explanatory view showing steps of a molding suspension in a method of molding according to this invention.

FIG. 2 shows steps of molding suspension. In case where a molding material M is a magnesium alloy (AZ 91D), which exhibits thixotropy properties in a solid-phase and liquid-phase coexisting temperature region, a temperature of the heating holding cylinder 2 is first increased from 560° C. to 610° C. to a liquidus temperature or higher that is 620° C. to 650° C. during suspension of molding. Then the temperature is kept until the resumption of molding and the semisolid molding material accumulated in the heating holding cylinder is replaced to be in a wholly molten material state. The molding after resumption is started after a wholly molten molding material has been discharged or after temporary molding of the wholly molten material is made, while supplying a semisolid material, to discharge the molten material.

Further, when a molding operation is finished with an excess semisolid material M1 remaining in the heating holding cylinder 2 without discharging the material M1, the semisolid material is slow cooled. Then a solid phase continues to grow until it reaches a solidus temperature so that it becomes a solid of a metal structure based on a large primary crystal (solid phase) by cooling solidification. This solid structure consists of a hard massive primary crystal and is difficult to melt. Moreover, even if the excess semisolid material Ml is heated to a temperature in the solid-phase and liquid-phase coexisting temperature region to be semi-molten, it does not return to a semisolid material, which exhibits thixotropy properties, and it becomes a semisolid material with high viscosity and extremely low fluidity. Accordingly, the excess semisolid material M1 cannot be used as the next molding material as it is. Therefore, it must be discharged from the heating holding cylinder 2 at the end of molding or before the start of molding.

Figure 3:
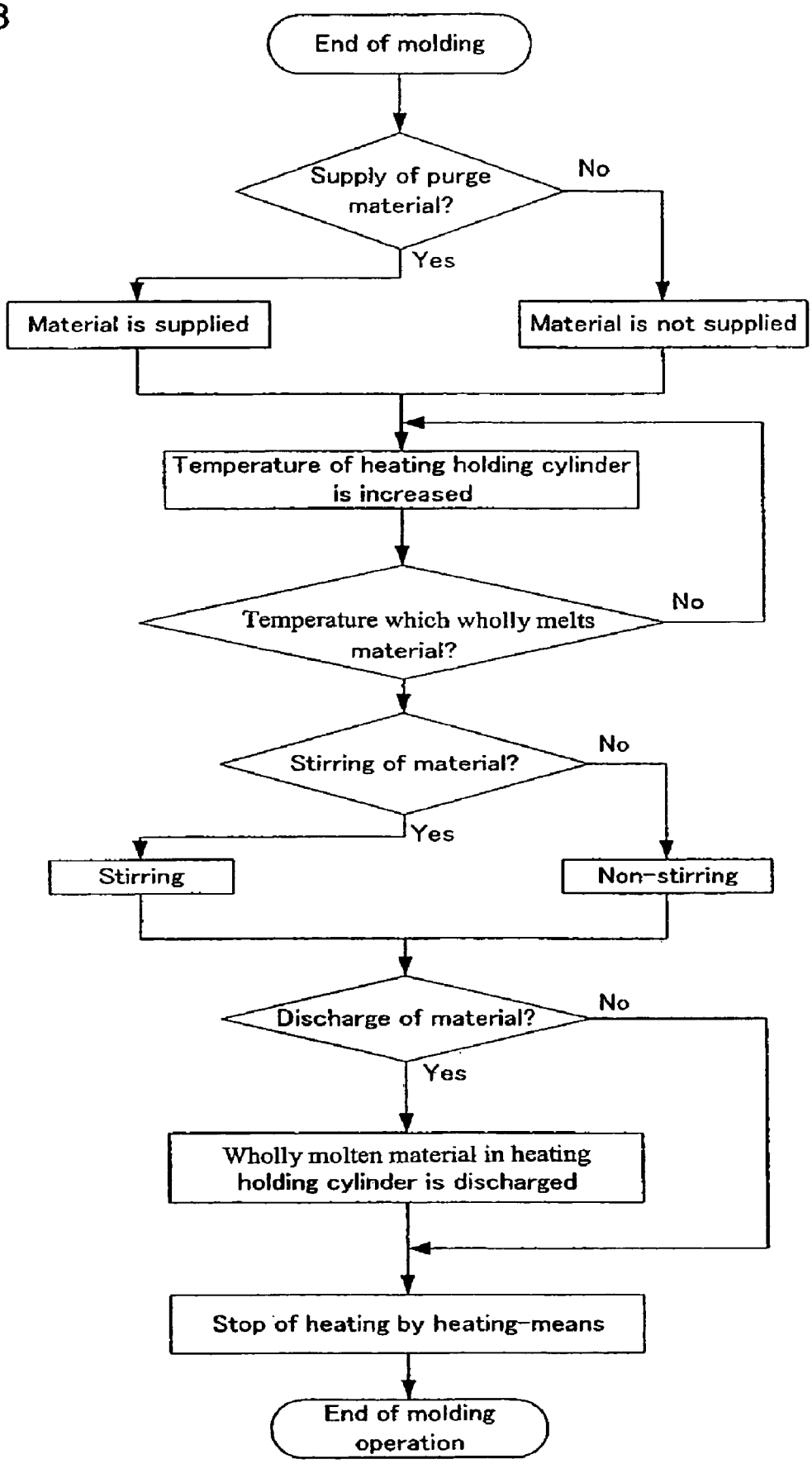
FIG. 3 is an explanatory view showing step of an end of molding in a method of molding according to this invention.

FIG. 3 shows two ways of the steps of finishing molding. In the one way, a temperature of the heating holding cylinder 2 is first increased from 560° C. to 610° C., to 620° C. to 650° C. If the temperature of the heating holding cylinder 2 has reached a set temperature, a remaining semisolid material is melted while keeping the temperature. Then after the remaining semisolid material is replaced with a wholly molten material, the wholly molten material is discharged. In this case, a remaining amount of the semisolid material in the heating holding cylinder at the end of molding is confirmed. Then if the remaining amount is much, a discharge of the remaining material is made without increasing the amount by a supply of a purge material.

Further if the remaining amount is a part for only a few shots, a substantially empty heating holding cylinder is heated. Thus the remaining material and a purge material are wholly melted while supplying a purge material to the molding material but not showing thixotropy properties in a solid-phase and liquid-phase coexisting state, is used.

In the discharge of the material the need or not of stirring is confirmed. If no stirring is needed, the injection means 26 is protrusively and retractively moved to discharge the material. If the stirring is needed, the stirring means 28 is rotated to stir the material. This stirring allows the oxide and solid phase in molten material to be dispersed and they are injected together with the molten material. Consequently, the inside of the heating holding cylinder is cleaned.

The discharge of the material is made by repeating measurement of the material by a backward movement of the injection means 26 and injection of the material to a mold not shown by a forward movement of the injection means 26. Since there is little viscosity of the material in a wholly molten material state, the molten material is not adhered to an inner wall surface of the heating holding cylinder 2 and to the injection plunger 26*a* and no material remains in the heating holding cylinder 2. Further, since scuff ing of the injection plunger 26*a* is prevented, the all amounts of the material can be easily discharged. Then if all of the wholly molten material in the heating holding cylinder 2 is discharged, heating of the material is stopped.

What is claimed is:

1. A method of molding a low melting point metal alloy comprising the steps of, while using a metallic raw material, which exhibits thixotropy properties in a solid-phase and liquid-phase coexisting temperature region, as a molding material, heating said molding material at a temperature in the solid-phase and liquid-phase coexisting temperature region to form a semisolid material, supplying a required amount of said semisolid material to a heating holding cylinder to be accumulated, and injecting said semisolid material into a mold by one shot from said heating holding cylinder, wherein a remaining semisolid material at an end of molding is heated at a liquidus temperature or higher to be melted, the material is injected in a wholly molten metal state and discharged from said heating holding cylinder, and heating is stopped so that the molding operation is finished.

2. The method of molding a low melting point metal alloy according to claim 1, wherein the discharge of said remaining semisolid material is performed by supplying a metallic raw material having the same composition as the molding material.

3. The method of molding a low melting point metal alloy according to claim 1 wherein stirring is performed in said wholly molten metal state.

4. The method of molding a low melting point metal alloy according to claim 2 wherein stirring is performed in said wholly molten metal state.

5. A method of molding a low melting point metal alloy comprising the steps of, while using a metallic raw material, which exhibits thixotropy properties in a solid-phase and liquid-phase coexisting temperature region, as a molding material, heating said molding material at a temperature in the solid-phase and liquid-phase coexisting temperature region to form a semisolid material, supplying a required amount of said semisolid material to a heating holding cylinder to be accumulated, and injecting said semisolid material into a mold by one shot from said heating holding cylinder, suspending molding temporarily, increasing a temperature of said heating holding cylinder to a liquidus temperature or higher to cause an accumulated semisolid material to be in a wholly molten metal state, at a resumption of molding, lowering the temperature of said heating holding cylinder to a temperature in the solid-phase and liquid-phase coexisting temperature region while discharging the material in a wholly molten metal state by injection thereof, supplying the molding material so that the contents in the heating holding cylinder are replaced with the supplied molding material, and restarting molding.

6. The method of molding a low melting point metal alloy according to claim 5 wherein stirring is performed in said wholly molten metal state.

* * * * *

UNITED STATES PATENT AND TRADEMARK OFFICE

CERTIFICATE OF CORRECTION

PATENT NO. : 7,032,640 B2
APPLICATION NO. : 11/066601
DATED : April 25, 2006
INVENTOR(S) : Kazuo Anzai It is certified that error appears in the above-identified patent and that said Letters Patent is hereby corrected as shown below:

Column 6, line 5, “mm.” should read --min.--;

Column 7, line 40, “scuff ing” should read --scuffing--.

Signed and Sealed this

Twenty-seventh Day of November, 2007

JON W. DUDAS
*Director of the United States Patent and Trademark Office*

UNITED STATES PATENT AND TRADEMARK OFFICE

CERTIFICATE OF CORRECTION

PATENT NO. : 7,032,640 B2
APPLICATION NO. : 11/066601
DATED : April 25, 2006
INVENTOR(S) : Kazuo Anzai It is certified that error appears in the above-identified patent and that said Letters Patent is hereby corrected as shown below:

Column 7, lines 17-22, replace the paragraph with the following paragraph:

--Further if the remaining amount is a part for only a few shots, a substantially empty heating holding cylinder is heated. Thus the remaining material and a purge material are wholly melted while supplying a purge material to the heating holding cylinder 2 to increase materials therein, and the molten materials are discharged. As the purge material, a metallic raw material, which is the same as the molding material or a metallic raw material having the same composition as the molding material but not showing thixotropy properties in a solid-phase and liquid-phase coexisting state, is used.--

Signed and Sealed this

Twenty Second Day of April, 2008

JON W. DUDAS
*Director of the United States Patent and Trademark Office*